US009382710B1

(12) United States Patent
Diaz

(10) Patent No.: US 9,382,710 B1
(45) Date of Patent: Jul. 5, 2016

(54) CUBICLE ASSEMBLY

(71) Applicant: Jaime Diaz, San Jose (CR)

(72) Inventor: Jaime Diaz, San Jose (CR)

( * ) Notice: Subject to any disclaimer, the term of this patent is extended or adjusted under 35 U.S.C. 154(b) by 0 days.

(21) Appl. No.: 14/495,778

(22) Filed: Sep. 24, 2014

Related U.S. Application Data

(60) Provisional application No. 61/881,569, filed on Sep. 24, 2013.

(51) Int. Cl.
*H02G 3/04* (2006.01)
*E04B 2/74* (2006.01)
*E04B 2/76* (2006.01)

(52) U.S. Cl.
CPC ..... *E04B 2/7416* (2013.01); *E04B 2/7433* (2013.01); *E04B 2/76* (2013.01); *E04B 2002/7461* (2013.01); *E04B 2002/7488* (2013.01)

(58) Field of Classification Search
CPC ... H02G 3/0418; H02G 3/0608; H02G 3/288; E04B 2002/7488; E04B 2002/749
USPC ..... 52/220.1, 220.7; 174/495–499
See application file for complete search history.

(56) References Cited

U.S. PATENT DOCUMENTS

| | | | | | |
|---|---|---|---|---|---|
| 1,965,598 | A * | 7/1934 | Koenig | 52/464 | |
| 1,981,239 | A * | 11/1934 | Manske | 52/220.7 | |
| 3,195,698 | A * | 7/1965 | Codrea | E04B 2/7435 | 174/499 |
| 3,377,756 | A * | 4/1968 | Polhamus | 52/220.7 | |
| 4,887,401 | A * | 12/1989 | Gioscia | 174/497 | |
| 5,086,194 | A * | 2/1992 | Bruinsma | H02G 3/128 | 174/493 |
| 5,479,747 | A * | 1/1996 | Wu | 52/220.7 | |
| 2002/0088188 | A1 * | 7/2002 | Chang | F21V 33/0032 | 52/238.1 |

* cited by examiner

*Primary Examiner* — Rodney Mintz
*Assistant Examiner* — Daniel Kenny
(74) *Attorney, Agent, or Firm* — Kenneth L. Tolar

(57) ABSTRACT

A cubicle assembly includes a frame formed of a plurality of interconnected rails for vertically supporting one or more partition panels to at least partially enclose a given workspace. A hollow lower rail and peripheral rails are configured to retain and conceal electrical wiring, such as network cables and power cords. Smaller interior rails can be fastened between the larger lower and peripheral rails to support multiple, adjacent partition panels similarly to a window-frame muntin. One or more corner covers conceal gaps formed between adjacent, angularly oriented frame sections. Accordingly, an unlimited number of support frames can be erected and interconnected to form an aesthetic barrier around a workspace.

20 Claims, 3 Drawing Sheets

CUBICLE ASSEMBLY

CROSS REFERENCE TO RELATED APPLICATIONS

This application is entitled to the benefit of provisional patent application No. 61/881,569 filed on Sep. 24, 2013, the specification of which is incorporated herein by reference.

BACKGROUND OF THE INVENTION

The present invention relates to a cubicle assembly that is configured to conceal wiring associated with various electrical and communication equipment.

DESCRIPTION OF THE PRIOR ART

Cubicles are often installed in a variety of locations, such as offices and classrooms, where larger rooms must be divided into smaller, more private work spaces. Conventional cubicles typically include an intricate framework for uprightly supporting a number of partitions that are constructed with sheet rock or gypsum. A conventional cubicle is laborious to install and the partitions generate irritating dust. Furthermore, the framework does not allow electrical or data-transmission wiring associated with telephones, computers and other typical office equipment to be easily concealed, inspected or rerouted. Accordingly, the wiring is readily visible to anyone nearby, which aesthetically diminishes the work space and exposes the wiring to potential damage. In addition, in order to partially-enclose a given space, a worker must position some of the partition frames at an angle relative to an adjacent frame, which creates unsightly gaps.

Therefore, there is currently a need for a cubicle assembly that overcomes the above-described disadvantages associated with conventional cubicles. The present invention addresses this need by providing a cubicle assembly having a lightweight support frame formed of various interconnected rails that are configured to enclose electrical wiring and conceal corner gaps.

SUMMARY OF THE INVENTION

The present invention relates to a cubicle assembly comprising a frame formed of a plurality of interconnected rails for vertically supporting one or more partition panels to at least partially enclose a given workspace. A hollow lower rail and one or more peripheral rails are configured to retain and conceal electrical wires, such power cords and network cables. The rails are formed of separable sections that allow the wires to easily inspected, if necessary. Smaller interior rails can be fastened between the larger lower and peripheral rails to support multiple, adjacent partition panels similarly to a window-frame muntin. One or more corner covers are attachable to adjacent, angularly oriented frame sections to conceal gaps formed therebetween. Accordingly, an unlimited number of support frames can be erected and interconnected to form an aesthetic barrier around a workspace that conveniently conceals electrical wiring.

It is therefore an object of the present invention to provide a cubicle assembly that conveniently conceals electrical wiring, such as network cables and power cords.

It is another object of the present invention to provide a cubicle assembly that allows concealed electrical wiring to be easily inspected or relocated.

It is yet another object of the present invention to provide a cubicle assembly that is easier to erect than conventional cubicles.

It is yet even another object of the present invention to provide a cubicle assembly that allows utilitarian partitions, such as dry-erase panels, chalk boards or louvered window panes to be easily integrated within a wall.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
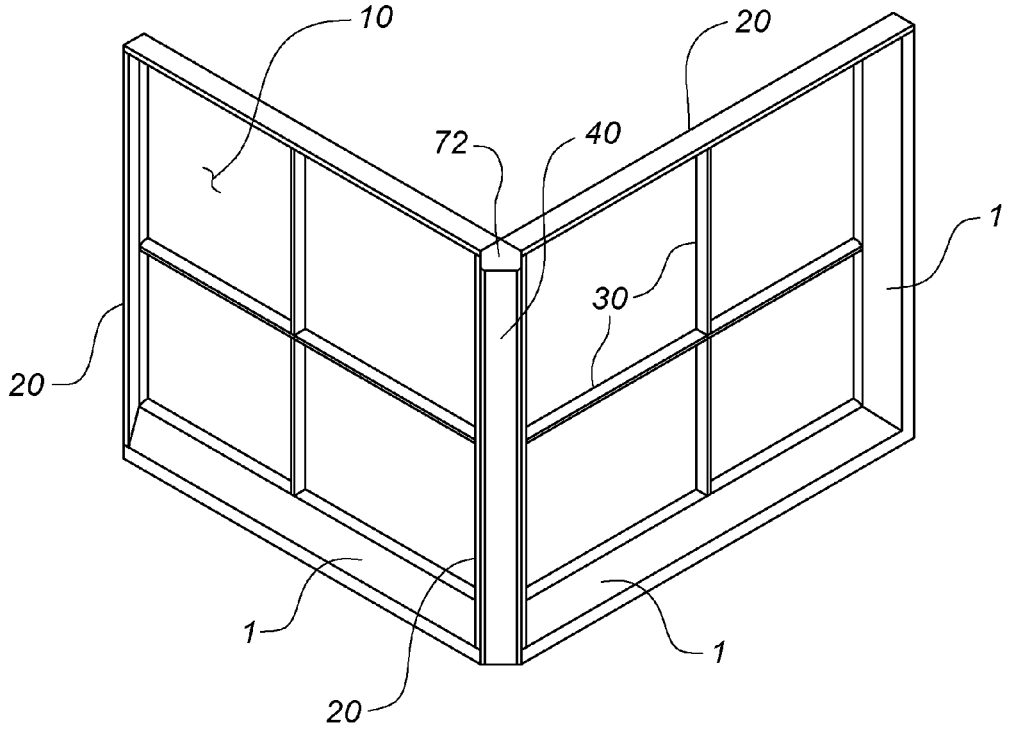
FIG. 1 is a perspective view of a pair of assembled support frames.
Figure 2:
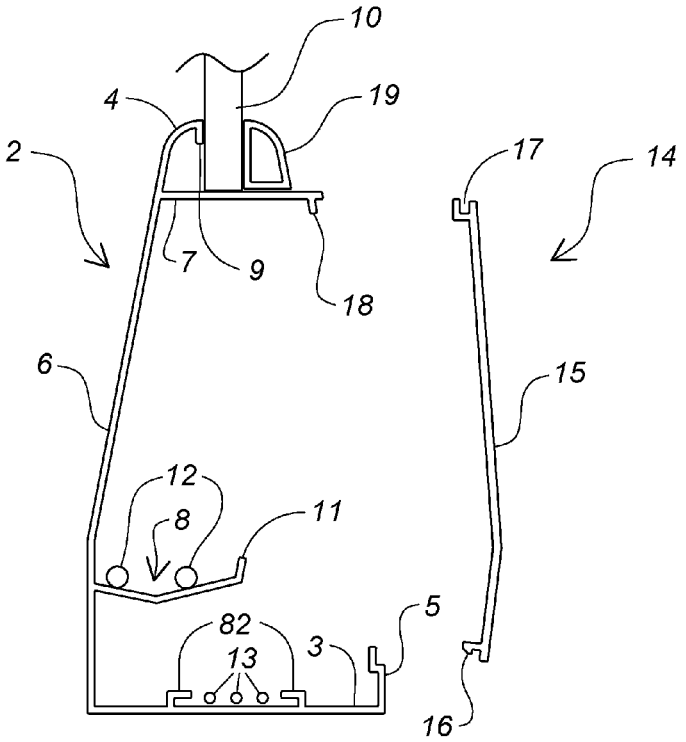
FIG. 2 is an isolated, sectional view of the lower rail.
Figure 3:
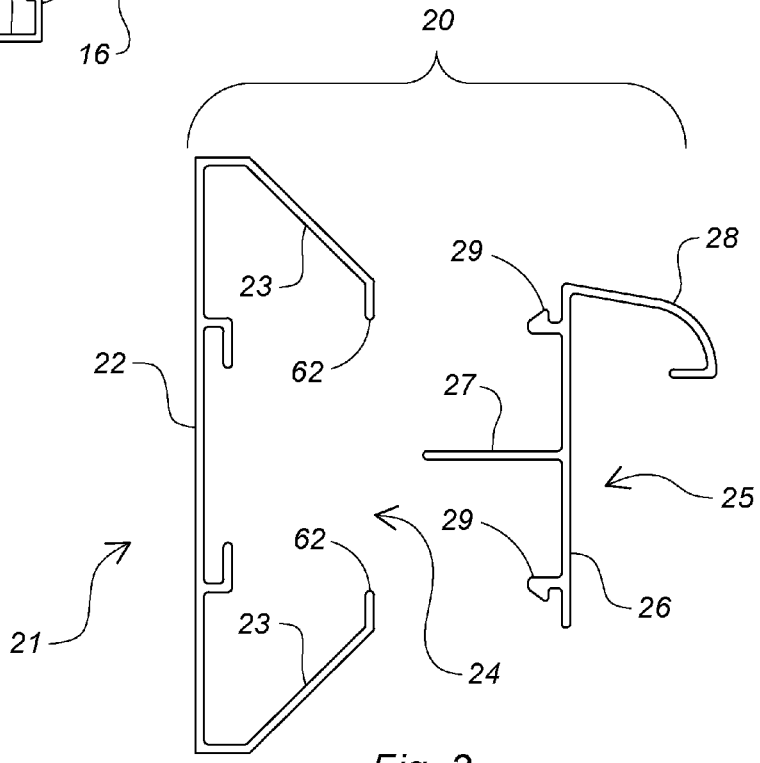
FIG. 3 is an isolated, sectional view of an exemplary peripheral rail.
Figure 4:
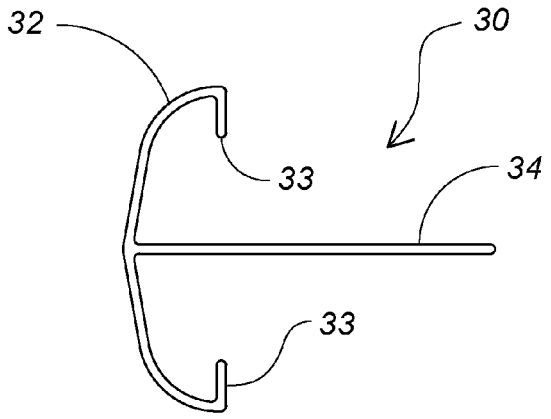
FIG. 4 is an isolated, sectional view of an exemplary interior rail.
Figure 5:
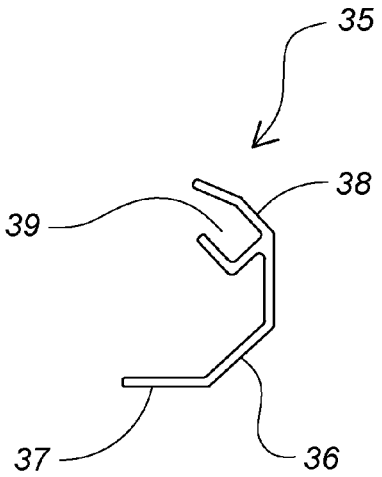
FIG. 5 is an isolated, sectional view of an exemplary corner cover support member.

The present invention relates to a cubicle assembly that is particularly designed to conceal electrical wiring, such as network cables and power cords. The assembly comprises a frame formed of a plurality of interconnected rails for vertically supporting one or more partition panels 10 to at least partially enclose a given workspace. A hollow lower rail 1 includes a front section 2 having a horizontal bottom wall 3, a high-profile outer wall 6 that terminates at an upper end 4 and a low-profile inner wall 5. Horizontally extending from the outer wall, near the upper end, is a platform 7 for supporting the lower edge of a partition panel 10. Depending from the upper end is a flange 9 that abuts a partition panel 10 resting on the platform 7.

Extending from the front section, near the bottom wall, is a cradle 8 having an upwardly protruding lip 11 at a distal end for securely retaining voice and data-transmission cables 12 connected to office equipment. On the bottom wall, beneath the cradle, are a pair of L-shaped retainers 82 for containing power cords 13 associated with computers and other electronic equipment. Accordingly, all electrical wiring can be completely concealed within the lower rail when a cubicle has been erected.

A rear section 14 is attachable to the front section to conceal and enclose the wiring stored within the lower rail. The rear section includes an elongated cover plate 15 having a latch 16 at a lower edge for gripping the inner wall 5, and an upper, U-shaped channel 17 for receiving a nib 18 depending from the platform. During assembly, once the rear section is properly attached to the front section, an elongated border strip 19 is adhesively secured to both the platform and the partition panel 10 to fix the partition to the lower rail. A second rail 1 of the type described above may also be used as an outermost side rail as depicted in FIG. 1.

The support frame further includes a plurality of peripheral rails 20 for forming the sides and/or tops of a given support frame or frame section. Each peripheral rail 20 includes a trapezoidal base portion 21 having a planar outer surface 22, converging front and rear walls 23 and an open inner side 24 in communication with a hollow interior. A cover 25 securable over the open inner side includes a planar spine 26 with a divider 27 extending from a first surface and an arcuate buttress 28 along an edge of the opposing side. Spaced from the divider 27 are a pair of snap members 29 that releasably engage the upper edges 62 of the converging sidewalls to secure the cover to the base portion. During assembly, a border strip 19 is also adhesively attached to the inner surface of the spine 26, at a predetermined distance from the buttress 28, to secure a side or top edge of a partition panel 10 therebetween.

A smaller, interior rail 30 can be used to form intermediate cross supports between the lower rail and the larger peripheral rails to interconnect multiple, adjacent partition panels similarly to a muntin in a window frame. The interior rail includes an arcuate shroud 32 with inwardly-extending flanges 33 at each of two side edges. A divider 34 extending from a convex surface of the shroud is positioned between two adjacent partition panels within a frame or frame section. A border strip 19 is securable to each side of the divider, abutting the adjacent partition panels.

The support frame further includes one or more corner covers 35 that easily conceal gaps 72 formed between adjacent, angularly oriented frame sections. The corner cover is fastened to the planar outer surface 22 of either or both peripheral-rail base portions that form the gap 72. The corner cover includes a substantially C-shaped sheet 36 having a lower portion 37 that is secured to the peripheral rail and an upper portion 38 having a slot 39 for slidably receiving a cover strip 40. Accordingly, each corner cover is secured to one of two adjacent peripheral rails that have created a gap therebetween due the relative positioning of two interconnected wall frames. The cover strip is slid into the slots to create a seamless joint between the two adjacent frame sections.

Accordingly, an unlimited number of support frames can be erected and interconnected to form an aesthetic barrier around a workspace. As the frame members are assembled, wires and cables can be easily concealed within the base and/or peripheral rails, as necessary. Furthermore, any combination of peripheral, lower and interior rails can be used to create an enclosure having a desired configuration. The frame members also allow a partition wall to be easily configured with window or door openings, or to be extended to a ceiling or anywhere below, as desired. Furthermore, the interior rails allow a user to easily incorporate a utilitarian partition, such as a dry-erase surface, a chalk board, a picture or a louvered window into a wall, thereby eliminating the need to suspend the article with nails, tacks or hangers.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A cubicle assembly comprising:

a frame formed of a hollow, lower rail and a plurality of peripheral rails, said peripheral rails each including a hollow base portion having an outer surface and an open inner side in communication with a hollow interior for receiving electrical wiring, said lower rail including a front section having a horizontal bottom wall, an upper end, an inner wall, an outer wall, a rear opening and a platform horizontally extending from the outer wall, near the upper end, for supporting a partition panel, and a pair of retainers on the bottom wall for containing electrical wiring;

a cradle extending from the outer wall of said lower rail for supporting and elevating additional electrical wiring;

means for securing at least one partition panel between said lower rail and said peripheral rails;

a cover securable over the open inner side of said peripheral rails, said cover including a planar spine for supporting a side edge of the partition panel with a buttress extending therefrom for engaging a front or rear surface of said partition.

2. The cubicle assembly according to claim 1 further comprising a rear section attachable to the front section to conceal and enclose the electrical wiring when stored within said lower rail.

3. The cubicle assembly according to claim 2 wherein said rear section includes a latch at a lower edge for engaging the inner wall on said lower rail, and an upper channel for receiving a nib depending from said platform.

4. The cubicle assembly according to claim 1 further comprising an elongated border strip securable to both the platform and the partition panel.

5. The cubicle assembly according to claim 1 further comprising an interior rail securable between the lower rail and the peripheral rails to support additional partition panels within said frame.

6. The cubicle assembly according to claim 1 further comprising at least one corner cover for concealing gaps formed between adjacent, angularly oriented peripheral rails.

7. The cubicle assembly according to claim 1 wherein said peripheral rails each further include a cover securable over the open inner side, said cover including a planar spine with a divider extending from a first surface and an arcuate buttress along an edge of the opposing side.

8. A cubicle assembly comprising:

a frame formed of a hollow, lower rail and a plurality of peripheral rails, said peripheral rails each including a hollow base portion having an outer surface and an open inner side in communication with a hollow interior for receiving electrical wiring, said lower rail including a front section having a horizontal bottom wall, an upper end, an inner wall, an outer wall, a rear opening and a platform horizontally extending from the outer wall, near the upper end, for supporting a partition panel, and a pair of retainers on the bottom wall for containing electrical wiring;

a cradle extending from the outer wall of said lower rail for supporting and elevating additional electrical wiring;

means for securing at least one partition panel between said lower rail and said peripheral rails;

an interior rail securable between the lower rail and the peripheral rails to support additional partition panels within said frame, wherein said interior rail includes an outer section formed of a shroud with a divider extending therefrom for positioning between two adjacent partition panels.

9. The cubicle assembly according to claim 8 further comprising a rear section attachable to the front section of said lower rail to conceal and enclose the electrical wiring when stored within said lower rail.

10. The cubicle assembly according to claim 9 wherein said rear section includes a latch at a lower edge for engaging the inner wall on said lower rail, and an upper channel for receiving a nib depending from said platform.

11. The cubicle assembly according to claim 8 further comprising an interior rail securable between the lower rail and the peripheral rails to support additional partition panels within said frame.

12. The cubicle assembly according to claim 8 further comprising at least one corner cover for concealing gaps formed between adjacent, angularly oriented peripheral rails.

13. A cubicle assembly comprising:

a frame formed of a hollow, lower rail and a plurality of peripheral rails, said peripheral rails each including a hollow base portion having an outer surface and an open inner side in communication with a hollow interior for receiving electrical wiring, said lower rail including a front section having a horizontal bottom wall, an upper end, an inner wall, an outer wall, a rear opening and a platform horizontally extending from the outer wall, near the upper end, for supporting a partition panel, and a pair of retainers on the bottom wall for containing electrical wiring;

a cradle extending from the outer wall of said lower rail for supporting and elevating additional electrical wiring;

means for securing at least one partition panel between said lower rail and said peripheral rails;

at least one corner cover for concealing gaps formed between adjacent, angularly oriented peripheral rails, wherein said corner cover includes an arcuate sheet having a lower portion that is secured to the peripheral rail and an upper portion having a slot for slidably receiving a cover strip.

14. The cubicle assembly according to claim 13 wherein said lower rail further includes a flange vertically depending from the upper end that abuts said partition panel.

15. The cubicle assembly according to claim 13 further comprising a rear section attachable to the front section to conceal and enclose the electrical wiring when stored within said lower rail.

16. The cubicle assembly according to claim 15 wherein said rear section includes a latch at a lower edge for engaging the inner wall on said lower rail, and an upper channel for receiving a nib depending from said platform.

17. A cubicle assembly comprising:

a frame formed of a hollow, lower rail and a plurality of peripheral rails, said peripheral rails each including a hollow base portion having an outer surface and an open inner side in communication with a hollow interior for receiving electrical wiring, said lower rail including a front section having a horizontal bottom wall, an upper end, an inner wall, an outer wall, a rear opening and a platform horizontally extending from the outer wall, near the upper end, for supporting a partition panel, and a pair of retainers on the bottom wall for containing electrical wiring;

a cradle extending from the outer wall of said lower rail for supporting and elevating additional electrical wiring;

means for securing at least one partition panel between said lower rail and said peripheral rails;

a cover securable over the open inner side of each of said peripheral rails, said cover including a planar spine with a divider extending from a first surface and an arcuate buttress along an edge of an opposing side.

18. The cubicle assembly according to claim 17 further comprising a rear section attachable to the front section to conceal and enclose the electrical wiring when stored within said lower rail.

19. The cubicle assembly according to claim 17 further comprising an interior rail securable between the lower rail and the peripheral rails to support additional partition panels within said frame.

20. A cubicle assembly comprising:

a hollow lower rail, said lower rail including a front section having a horizontal bottom wall, an upper end, an inner wall, an outer wall, a rear opening and a platform horizontally extending from the outer wall, near the upper end, a pair of side rails connected to said lower rail;

an upper rail connected to said side rails, wherein said upper rail and each of said side rails include a hollow base portion having an outer surface and an open inner side in communication with a hollow interior for receiving electrical wiring;

means for securing a first partition panel between said lower rail, said side rails and said upper rail;

at least one interior rail securable between the lower rail, the upper rail and the side rails to support a second partition panel, said interior rail including an outer section formed of a shroud with a divider extending therefrom for positioning between two adjacent partition panels.

* * * * *